US005168034A

United States Patent [19]

Tamagawa et al.

[11] Patent Number: 5,168,034

[45] Date of Patent: Dec. 1, 1992

[54] PHOTOGRAPHIC PRINTING PAPER SUPPORT

[75] Inventors: Shigehisa Tamagawa; Shinichiro Serizawa, both of Shizuoka, Japan

[73] Assignee: Fuji Photo Film Co., Ltd., Kanagawa, Japan

[21] Appl. No.: 854,914

[22] Filed: Mar. 20, 1992

[30] Foreign Application Priority Data

Mar. 20, 1991 [JP] Japan ..... 3-083075

[51] Int. Cl.[5] ..... G03C 1/76

[52] U.S. Cl. ..... 430/536; 428/488.1; 428/513; 428/516; 428/537.1; 430/538

[58] Field of Search ..... 430/536, 538; 428/488.1, 513, 516, 557.1

[56] References Cited

U.S. PATENT DOCUMENTS

| | | | |
|---|---|---|---|
| 3,669,709 | 6/1972 | Kasugal et al. | 430/538 |
| 3,671,248 | 6/1972 | Eldridge et al. | 430/538 |
| 3,682,639 | 8/1972 | Barbeham et al. | 430/538 |
| 3,684,510 | 8/1972 | Psaar et al. | 430/538 |
| 4,269,927 | 5/1981 | Atwell | 430/538 |
| 4,895,757 | 1/1990 | Wisk et al. | 430/538 |

*Primary Examiner*—Jack P. Brammer

*Attorney, Agent, or Firm*—Sughrue, Mion, Zinn, Macpeak & Seas

[57] ABSTRACT

A photographic printing paper support is disclosed comprising a base paper having a polyolefin coated on both sides thereof, wherein the base paper is internally sizing-treated with an epoxidized fatty acid amide composition comprising (1) behenic acid or a higher fatty acid mixture having behenic acid as a main component, at least one of diethylenetriamine and triethylenetetramine and (3) epichlorohydrin.

7 Claims, No Drawings

PHOTOGRAPHIC PRINTING PAPER SUPPORT

FIELD OF THE INVENTION

The present invention relates to a support for a photographic printing paper, and more specifically, a support for a photographic printing paper by which edge contamination of photographic printing papers is improved.

BACKGROUND OF THE INVENTION

Photographic printing papers are not required to absorb the processing liquid during development processing; therefore, attempts have been made to lower the absorption of the processing solution into the paper of the support. One method is sizing of paper to lower the absorption of a processing solution. As is well known, a conventional baryta paper has been treated by only this method. However, this method is still insufficient to lower the absorption of the processing solution.

Another method of lowering the absorption of the processing solution by a support is to coat both surfaces of a base paper with a water-resistant film such as a polyolefin. By this method, the penetration of the treating solution into the base paper is only from the cut surface at an end, but the penetration of the processing solution from the cut surface cannot be prevented completely. The treating solution, which cannot be taken off by water washing, becomes discolored by heat and the passing of time, and becomes a so-called edge contamination. This edge contamination becomes a spotted brown stain in the white portion of a photograph, and lowers the value of the photograph markedly.

The edge contamination does not appear if water washing, after development, is carried out for a long time. But this contradicts the requirement of carrying out the processing treatment within a short period of time. For this reason, it was strongly desired to lower the absorption of the processing solution from the cut surface.

It was heretofore considered to apply a sizing agent to the base paper in order to lower the absorption of the processing solution. A sizing agent like a fatty acid soap, such as sodium stearate (JP-B-47-26961) or an alkyl ketene dimer (JP-A-51-132822), and a cationic sizing agent obtained by the reaction of a carboxylic acid with a polyamine (JP-A-54-147032) have been used for supports in photographic printing papers (the term "JP-A" used herein means an unexamined published Japanese patent application, and the term "JP-B" used herein means an examined published Japanese patent application.).

However, with sizing agents of the fatty acid soap type, the absorption of the treating liquid cannot be lowered to below the present level, and it is affected by the quality of water used for the production of the base paper. When the water has a high hardness, sufficient effects cannot be obtained because of precipitate formed.

Furthermore, when an alkyl ketene dimer is used, the adhesion between the base paper and the polyolefin or a polystyrene film is poor, and to increase the adhesion, another step is required. When the cationic sizing agent, obtained by reacting a carboxylic acid with a polyamine, is used, the absorption of the processing solution may be lowered, but coloration due to the processing solution absorbed cannot be avoided.

The present inventors have made extensive investigations in order to remedy the above defect, and found that when both surfaces of a base paper, internally treated with a specified sizing agent, are coated with a polyolefin, edge contamination is markedly improved, and a photographic printing paper suitable for rapid processing can be obtained. This finding has led to the present invention.

SUMMARY OF THE INVENTION

It is the first object of the present invention to provide a support for a photographic printing paper which has a low absorbability in regard to the processing solution.

A second object of the present invention is to provide a support for a photographic printing paper which is suitable for rapid treatment without any defect of photographic properties such as fog.

The above objects of the present invention are achieved by a photographic printing paper support comprising a base paper having a polyolefin coated on the both sides thereof, wherein the base paper is internally sizing-treated with an epoxidized fatty acid amide composition comprising a higher fatty acid, at least one of diethylenetriamine and triethylenetetramine, and epichlorohydrin.

DETAILED DESCRIPTION OF THE INVENTION

The material of the base paper used in the present invention is not particularly limited. It may be a natural pulp selected from conifers and broad-leaf trees. If required, it may be a mixture of the natural pulp and a synthetic pulp in an arbitrary ratio.

The epoxidized fatty acid amide to be internally added to the base paper in the present invention is a compound represented by Formula (I):

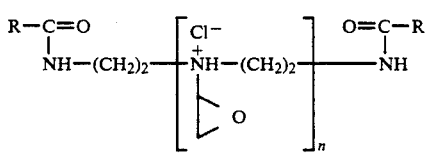

(I)

wherein R is a higher alkyl group having 10 to 30 carbon atoms, preferably a straight-chain alkyl group of $C_{21}H_{43}$, and n is an integer of 1 or 2.

The above compound can be easily obtained by reacting a higher fatty acid containing behenic acid as the main component, at least one of diethylenetriamine and triethylenetetramine and epichlorohydrin as main components by a known method. The higher fatty acid may be a mixture of at least two compounds. In the present invention, at least 60% by weight of the higher fatty acid is preferably behenic acid.

The mole ratio of diethylenetriamine to triethylenetetramine used in the present invention is preferably from 5:95 to 60:40, more preferably 10:90 to 50:50.

The amount of epichlorohydrin used in the present invention may be 0.6 to 1.2 equivalents, preferably 0.9 to 1.1 equivalents, based on the amino groups of diethylenetriamine and triethylenetetramine which do not react with the fatty acids (amino groups other than those at both ends).

The amount of the epoxidized fatty acid amide composition added is preferably 0.1 to 1.0% by weight, more preferably 0.3 to 0.8% by weight, based on the weight of the entire base paper.

The epoxidized fatty acid amide composition can be internally added to the base paper by adding the necessary amount of the composition to the pulp water, without the necessity of special operation. To fix the composition to the pulp uniformly, it is desirably added foremost.

Since the base paper, to which the epoxidized fatty acid amide is internally added, inhibits the absorption of the developing solution, the coloration of the entire photographic printing paper is prevented.

To further increase the effect of inhibiting the absorption of the developing solution into the base paper in the present invention, it is preferable to add the anionic polyacrylamide (A) and the cationic polyacrylamide (B) to the base paper. The weight ratio of the anionic polyacrylamide (A) to the cationic polyacrylamide (B) is preferably 90:10 to 40:60.

The anionic polyacrylamide which may be added to the base paper in the present invention is not particularly limited, and may be properly selected from known anionic polyacrylamides as disclosed, for example, in *Kami oyobi Seni Kakoyo Jusi to sono Sikenho,* p.283, (Shokodo, 1968). Examples of the anionic polyacrylamides include a polyacrylamide which is heated in the presence of alkali and then patially hydrolyzed, an acrylamide/acrylic acid copolymer, an acrylamide/methacrylic acid copolymer and an acrylamide/maleic acid copolymer, which may be further copolymerized with a monomer unit such as acrylonitrile and acrylic acid ester. The molecular weight of the anionic polyacrylamide may be not less than 500,000, preferably 600,000 to 1,200,000.

The cationic polyacrylamide, which may be added to the base paper in the present invention, is preferably a cationic polyacrylamide having a cationic value of 1.5 to 4.0 ml/g, more preferably 2 to 3.5 ml/g, and a molecular weight of 500,000 to 1,500,000, more preferably 700,000 to 1,000,000, and which may be obtained by copolymerizing an acrylamide with a cationic monomer.

The amount of the anionic polyacrylamide and cationic polyacrylamide are preferably added in an amount of 0.2 to 3%, more preferably 0.5 to 1.5%, and 0.05 to 1.5%, more preferably 0.1 to 1.0%, respectively, based on the weight of the entire base paper. The total amount thereof is preferably 0.5 to 4%, more preferably 0.6 to 2.5%, based on the weight of the entire base paper.

In the present invention, the cationic polyacrylamide may be a ternary copolymer consisting of (meth)acrylic acid copolymerized with an acrylamide and a cationic monomer.

The cationic value of the cationic acrylamide was determined in the following manner.

About 0.1 g of a sample of the cationic polyacrylamide was precisely weighed. A solution diluted with a diluting liquid (a liquid comprising water/methanol/acetic acid=89/10/1 by volume) was titrated with an aqueous solution of 1/400 N polyvinyl potassium sulfate. The titration result was inserted into the following formula.

$$\frac{\text{Titration value (ml)} \times 1/400 \times \text{Factor } (PVSK)^{*}}{\text{Amount of the sample (g)} \times \text{involatile content (\%)}/100}$$

*Factor (*PVSK*) is nearly 1.

As to the involatile content, 3.0±0.2 g of the sample was uniformly spread on a Petri dish (50 mm×15 mm) and precisely weighed, then dried for 3 hours in a circulating air dryer at 105°±5° C., then put in a desiccator and allowed to cool for 30 minutes, and precisely weighed. The dry residual amount was determined and inserted into the following formula, and the involatile content was calculated.

$$\text{Involatile content (\%)} = \frac{\text{dry weight (g)}}{\text{amount of the sample taken (g)}} \times 100$$

The cationic monomer to be copolymerized with acrylamide is preferably a compound represented by Formulae (II) and (III) or salts thereof;

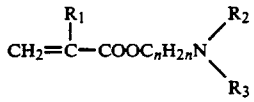

(II)

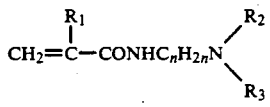

(III)

wherein $R_1$ is a hydrogen atom or an alkyl group having 1 to 5 carbon atoms, $R_2$ and $R_3$ are an alkyl group having 1 to 5 carbon atoms, and n represents an integer of 1 to 5.

Specific examples of the cationic monomer include, for example, dimethylaminoethyl methacrylate ($CH_2{=}C{-}(CH_3)COOCH_2CH_2N(CH_3)_2$), diethylaminoethyl methacrylate ($CH_2{=}C{-}(CH_3)COOCH_2CH_2N(CH_2CH_3)_2$), dimethylaminoethyl methacrylic acid chloride ($[CH_2{=}C(CH_3)COOCH_2CH_2N\ (CH_3)_3]Cl$) and dimethylaminopropyl acrylamide ($CH_2{=}C(CH_3)CONHCH_2CH_2CH_2N(CH_3)_2$).

If desired, additive chemicals ordinarily used may be contained in the base paper. Examples of these chemicals include, for example, paper strengthening agents such as starch, polyvinyl alcohol, carboxymethyl cellulose and polyamidepolyamineepichlorohydrin; fillers such as titanium dioxide, clay, tale, calcium carbonate and urea resin; additional sizing agents such as rosin, alkyl ketene dimer, higher fatty acid salts, paraffin wax, and alkenylsuccinic acids; fixing agents such as paper maker's alum and aluminium chloride; dyes; fluorescent dyes; slime controlling agents; and antifoaming agents.

The base paper may be impregnated or coated with a liquid containing various water-soluble additives with a size press, a tub size or a gate roll coater, for a surface sizing treatment.

Specific examples of the water-soluble additives include high molecular weight compounds for increasing surface strength, such as starch, polyvinyl alcohol, carboxy-modified polyvinyl alcohol, carboxymethyl cellulose, hydroxyethyl cellulose, sodium alginate, cellulose sulfate, gelatin and casein, and metal salts for preventing static charge, such as calcium chloride, sodium chloride and sodium sulfate.

The liquid containing the water-soluble additives may further contain moisture-absorbing substances such as glycerol and polyethylene glycol, dyes, coloration and brightening agents such as fluorescent brightening agents, and pH controlling agents such as sodium hydroxide, aqueous ammonium, hydrochloric acid, sulfuric acid and sodium carbonate. Furthermore, as required, pigment, etc. may be added to the above aqueous solution.

The base paper can be easily produced by a conventional process. Its basis weight is desirably 50 to 250 g/m$^2$. In view of the plainness of the photographic printing paper, the base paper is desirably surface-treated by applying heat and pressure with a machine calender or a supercalender.

Hence, the base paper of the present invention is preferably produced by calendering and winding it up after final drying.

Both surfaces of the base paper, produced as described above are extrusion-coated with a well-known polyolefin resin to obtain the support of the present invention.

As the facilities of the extrusion coating, a conventional polyolefin extruding machine and a laminator may be used.

Examples of the polyolefin resin are homopolymers of α-olefins such as polyethylene and polypropylene, and mixtures of these polymers. Especially preferred polyolefins are high-density polyethylene, low-density polyethylene and mixtures thereof. So far as these polyolefins can be extrusion-coated, there is no particular limitation on their molecular weight. Usually, polyolefins having a molecular weight of 20,000 to 200,000 may be used.

There is no particular limitation on the thickness of the polyolefin resin layer, and it may be determined according to the thickness of a coated layer in a conventional support of a photographic printing paper, but it is preferably 15 to 50 μm.

Known additives such as a white pigment, a colored pigment, a fluorescent brightening agent and an antioxidant agent may be added to the polyolefin resin layer. It is preferred to add a white pigment or a colored pigment to the polyolefin resin layer on the side on which a photographic emulsion is coated.

The photographic printing paper support of the present invention is generally coated with a photographic emulsion layer on one side and dried to form a photographic printing paper. If desired, a printed letter preserving layer may be formed on the other side as disclosed, for example, in JP-A-62-6256, and various modified examples are possible.

The photographic printing paper support of the present invention has a very low absorbability in regard to the processing solution from a cut surface of the photographic printing paper; and, therefore, edge contamination of a photograph can be remedied. Accordingly, the photographic printing paper support of the present invention is advantageous when it has to be rapidly developed.

In the following, the present invention will be further illustrated in detail by examples, but the invention will not be restricted by these examples. Unless otherwise indicated herein, all the parts, parcents, ratios and the like are by weight.

EXAMPLE 1

A mixed pulp composed of 50 parts of LBKP (Laubholz Bleached Kraft Pulp), 30 parts of LBSP (Laubholz Bleached Sulfite Pulp) and 20 parts of NBSP (Nadelholz Bleached Sulfite Pulp) was beaten to a Canadian freeness of 250 ml (measured according to Japanese Industrial Standard P-8121) by a double discrefiner. The chemicals shown in Table 1 were added in the sequence described to 100 parts of the resulting pulp slurry, and paper making was performed. The resulting paper was dried to give a base paper having a base weight of 180 g/m$^2$.

TABLE 1

| | |
|---|---|
| Pulp | 100 parts |
| Added chemicals | |
| Epoxidized behenic acid amide composition* | 0.6 parts |
| Anionic polyacrylamide (a polyacrylamide modified with acrylic acid, molecular weight of 800,000) | 1.0 parts |
| Aluminum sulfate | 1.5 parts |
| Polyamidepolyamine epichlorohydrin | 0.2 parts |
| Sodium hydroxide | proper (pH 7.0) |
| Cationic polyacrylamide** (cationic value = 2.8 ml/g) | 0.5 parts |
| Antifoamer | 0.1 parts |

*A composition consisting of 100 parts of behenic acid, 3.1 parts of diethylenetriamine and 17.2 parts of triethylenetetramine (the mole ratio of 20:80), and 23.2 parts (0.95 equivalent) of epichlorohydrin.

**A terpolymer obtained from acrylamide, acrylic acid and dimethylaminopropylacrylamide in the mole ratio of 70:20:10.

The resulting base paper was impregnated with an aqueous solution shown in Table 2 in an amount of 30 g/m$^2$ with a size press treatment.

TABLE 2

| | |
|---|---|
| Polyvinyl alcohol | 5.0 parts by weight |
| Calcium chloride | 3.0 parts by weight |
| Fluorescent brightening agent (diaminostylben sulfonic acid derivative) | 0.5 parts by weight |

The resulting paper was treated with a machine calender to a thickness of 175 μm. The back surface was subjected to corona discharge treatment and then coated with polyethylene having a density of 0.98 g/cm$^3$ in a thickness of 25 μm. The front surface (the side on which a photographic emulsion was to be coated) was subjected to corona discharge treatment, and then coated with a polyethylene having a density of 0.94 g/cm$^3$ containing 10% by weight of titanium dioxide in a thickness of 30 μm to form a photographic printing paper support 1.

The resulting photographic paper support was cut to a width of 8.25 cm, and then subjected to development with a color paper automatic developer (RPV-409 type, made by Noritsu Koki Co., Ltd.). The distance of penetration of the developping solution from the cut surface was measured by using a magnifying glass. The results obtained are shown in Table 7.

EXAMPLE 2

The process of Example 1 was repeated except that the epoxidized behenic acid amide composition used in Example 1 was replaced by the composition having the component shown in Table 3, to obtain a photographic printing paper support 2. The resulting support was examined on the penetration distance of a developping solution in the same manner as in Example 1. The results obtained are shown in Table 7.

TABLE 3

| Epoxidized behenic acid amide composition | |
|---|---|
| Behenic acid | 85 parts |
| Arachic acid | 15 parts |
| Diethylenetriamine* | 1.5 parts |
| Triethylenetetramine* | 18.8 parts |
| Epichlorohydrin | 26.2 parts |

TABLE 3-continued

| Epoxidized behenic acid amide composition | |
|---|---|
| | (1.05 equiv.) |

*The mole ratio of diethylenetriamine to triethylenetetramine is 10:90.

EXAMPLE 3

The process of Example 2 was repeated except that the anionic polyacrylamide and cationic polyacrylamide used in Example 2 was replaced by 1.5 parts of cationic starch as a paper strengthening agent, to obtain a photographic printing paper support 3. The resulting support was examined on the penetration distance of a developping solution in the same manner as in Example 1. The results obtained are shown in Table 7.

COMPARATIVE EXAMPLE 1

The process of Example 1 was repeated except that the epoxidized behenic acid amide composition used in Example 1 was replaced by the composition having the component shown in Table 4, to obtain a photographic printing paper support 4. The resulting support was examined on the penetration distance of a developping solution in the same manner as in Example 1. The results obtained are shown in Table 7.

TABLE 4

| | |
|---|---|
| Behenic acid | 80 parts |
| Arachic acid | 20 parts |
| Dimethylaminopropylamine | 30.7 parts |
| Epichlorohydrin | 13.7 parts |
| | (0.5 equiv.) |

COMPARATIVE EXAMPLE 2

The process of Example 1 was repeated except that the epoxidized behenic acid amide composition used in Example 1 was replaced by the composition having the component shown in Table 5, to obtain a photographic printing paper support 5. The resulting support was examined on the penetration distance of a developping solution in the same manner as in Example 1. The results obtained are shown in Table 7.

TABLE 5

| | |
|---|---|
| Behenic acid | 50 parts |
| Arachic acid | 50 parts |
| Tetraethylenepentamine | 29.0 parts |
| Epichlorohydrin | 63.8 parts |
| | (1.5 equiv.) |

COMPARATIVE EXAMPLE 3

The process of Example 1 was repeated except that the epoxidized behenic acid amide composition used in Example 1 was replaced by the composition having the component shown in Table 6, to obtain a photographic printing paper support 6. The resulting support was examined on the penetration distance of a developping solution in the same manner as in Example 1. The results obtained are shown in Table 7.

TABLE 6

| | |
|---|---|
| Stearic acid | 60 parts |
| Palmitic acid | 40 parts |
| Triethylene tetramine | 26.7 parts |
| Epichlorohydrin | 27.1 parts |
| | (0.8 equiv.) |

TABLE 7

| Photographic printing paper support No. | Penetration distance of developing solution (mm) |
|---|---|
| 1 (Example 1) | 0.09 |
| 2 (Example 2) | 0.12 |
| 3 (Example 3) | 0.19 |
| 4 (Com. Ex. 1) | 0.35 |
| 5 (Com. Ex. 2) | 0.43 |
| 6 (Com. Ex. 3) | 0.51 |

The results above demonstrate that the photographic printing paper supports of the present invention have excellent characteristics in that only a small amount of the developing solution is absorbed.

While the invention has been described in detail and with reference to specific embodiments thereof, it will be apparent to one skilled in the art that various changes and modifications can be made therein without departing from the spirit and scope thereof.

What is claimed is:

1. A photographic printing paper support comprising a base paper having a polyolefin coated on the both sides thereof, wherein said base paper comprises an epoxidized fatty acid amide composition comprising (1) behenic acid or a higher fatty acid mixture having behenic acid as a main component, (2) diethylenetriamine and triethylenetetramine in the mole ratio of 5:95 to 60:40 and (3) 0.6 to 1.2 equivalents, based on the amino groups of the diethylenetriamine and triethylenetetramine which do not react with the fatty acids, of epichlorohydrin.

2. A photographic printing paper support as in claim 1, wherein said base paper further contains (A) an anionic polyacrylamide, and (B) a cationic polyacrylamide in weight ratio of 90:10 to 40:60.

3. A photographic printing paper support as in claim 1, wherein at least 60% by weight of the higher fatty acid mixture is behenic acid.

4. A photographic printing paper support as in claim 1, wherein the mole ratio of diethylenetriamine to triethylenetetramine is from 10:90 to 50:50.

5. A photographic printing paper support as in claim 1, wherein the epoxidized fatty acid amide composition is from 0.1 to 1.0% by weight, based on the weight of the entire base paper.

6. A photographic printing paper support as in claim 2, wherein the cationic polyacrylamide has a cationic value of 1.5 to 4.0 ml/g.

7. A photographic printing paper support as in claim 2, wherein the cationic polyacrylamide is present in an amount of 0.1 to 1.0% by weight, based on the weight of the entire base paper.

* * * * *